United States Patent [19]

Bowling

[11] 4,204,506

[45] May 27, 1980

[54] FUEL DELIVERY SYSTEM

[76] Inventor: William M. Bowling, 5321 E. Calle Del Medio, Phoenix, Ariz. 85018

[21] Appl. No.: 771,962

[22] Filed: Feb. 25, 1977

[51] Int. Cl.[2] ..... F02M 59/02

[52] U.S. Cl. ..... 123/137; 123/23; 123/24 R; 123/32 R; 222/361

[58] Field of Search ..... 123/32 R, 32 JV, 137, 123/188 AF, 188 VA, 75 B, 23, 24 R, 24 A; 239/331; 222/361, 409

[56] References Cited

U.S. PATENT DOCUMENTS

| | | | |
|---|---|---|---|
| 79,938 | 7/1868 | Babbitt | 123/24 |
| 728,873 | 5/1903 | Cundall | 123/137 |
| 1,719,023 | 7/1929 | Pawlikowski | 123/23 |
| 1,821,396 | 9/1931 | Nardin | 123/32 R |
| 1,923,666 | 8/1933 | French | 123/32 R |
| 1,970,866 | 8/1934 | Reed | 123/137 |
| 2,267,907 | 12/1941 | Gehres | 123/32 R |
| 2,419,096 | 4/1947 | Stickney | 123/32 R |
| 3,981,277 | 9/1976 | Abom | 123/23 |

FOREIGN PATENT DOCUMENTS

| | | | |
|---|---|---|---|
| 82675 | 8/1895 | Fed. Rep. of Germany | 123/23 |
| 420606 | 2/1924 | Fed. Rep. of Germany | 123/137 |
| 509507 | 10/1930 | Fed. Rep. of Germany | 123/23 |
| 568413 | 1/1933 | Fed. Rep. of Germany | 123/23 |
| 22531 | 10/1904 | United Kingdom | 123/23 |
| 10011 | 5/1911 | United Kingdom | 123/24 |
| 269163 | 5/1928 | United Kingdom | 123/33 |

*Primary Examiner*—Charles J. Myhre
*Assistant Examiner*—Andrew M. Dolinar
*Attorney, Agent, or Firm*—Gregory J. Nelson

[57] ABSTRACT

A fuel delivery system for an internal combustion engine. A fuel supply chamber is located adjacent the combustion chamber and is in communication with the combustion chamber. A fuel supply line communicates with the fuel chamber. A valving piston is movable in said fuel chamber and a fuel port or pocket is formed between the valving piston and the fuel chamber. The valving piston is actuable to place the fuel port in communication with the combustion chamber to deliver discrete quantities of fuel to support combustion. The valving piston may be mechanically, hydraulically, pneumatically or electrically operated. Means are also disclosed which cooperate with the valving piston to expel fuel from the port in the fuel delivery position.

4 Claims, 12 Drawing Figures

FUEL DELIVERY SYSTEM

The present invention relates to a fuel delivery system for internal combustion engines and more particularly relates to a fuel delivery system adaptable to both combustion ignition and spark ignition systems in which a fuel charge is transported in discrete, predetermined quantities to a combustion chamber or area.

Internal combustion engines ae of two predominant types, the spark ignition engine which operates on the Otto cycle and the compression ignition engine which operates on the Diesel cycle.

Fuel is delivered to the combustion chambers of spark ignition engines conventionally by carburetion devices. A carburetor meters and atomizes and mixes the fuel with air flowing to the engine. Conventional carburetion design includes a float which maintains a fuel level in a float chamber. Air flows into the carburetor and through a venturi which causes fuel to flow from the float chamber through a fuel jet into the air stream where it is directed to the combustion area. Fuel atomization is accomplished by the difference between the air and fuel velocities at the jet. More complex carburetors have multiple barrels and multiple jets to compensate for various operating conditions and to provide increased power at certain operating conditions.

Contrary to spark ignition engines, Diesel engines generally receive fuel through a fuel injection system. The fuel injection system for Diesel cycle engines generally consists of a pump, fuel supply line and a nozzle. These elements control the initiation, rate and duration of injection and meter the desired amount of fuel and further serve to atomize and distribute the fuel in the combustion chamber. In the injection system, the pump forces a predetermined amount of fuel through a fuel line and an atomizing nozzle into the combustion chamber. Injection pressures typically may range from 1500 to 7000 psi and may be even higher. It may also be necessary to provide separate fuel pumps for each cylinder chamber. Various types of injection nozzles are used, however, problems often occur with nozzles in that the tips are subjected to heat and may foul due to accumulation of products of combustion. It is noted that spark ignition engines may also be supplied with fuel through fuel injection systems similar to the type described above usually to achieve high performance.

Most of the work done to date in the field of fuel injection systems involves nozzle design to minimize fouling of the injection tip. Other approaches to improving design of injected engines, particularly of the combustion ignition type, involve stratified combustion type engines usually having a pre-combustion chamber communicating with the main combustion chamber.

The disadvantages to such systems is that they are generally complex involving either nozzle designs which are expensive to manufacture and maintain or combustion chamber design which is costly and complex. Further, such new designs do not eliminate the exposure of the nozzle to high temperatures and products of combustion and high pressure regulated fuel supply is still necessary. Further, these systems using conventional or improved injectors do not lend themselves to a variety of fuels and are incapable of handling powdered solid fuels.

The present invention provides an improved fuel delivery system adaptable to both spark ignition and combustion ignition engines in which a fuel charge is transported to the combustion chamber or space in discrete quantities by displacement of a valving piston. In one embodiment of the invention, the valving piston is provided with a fuel port in the form of an annular groove which in one position is in communication with a fuel supply. The annular space is filled with fuel and at a preselected time in the combustion cycle the valving piston is then moved to a delivery position in the combustion space. The piston may be actuated by any suitable means such as mechanical valving, hydraulic, pneumatic or electrical actuation. The piston is retracted and the fuel charge discharged in the combustion chamber. The advantage of the system of the present invention is that the system is simple eliminating the need for high pressure fuel delivery systems. Further, injection nozzles which tend to foul or burn are eliminated. The system is also adaptable to a variety of fuels including high viscosity and even solid fuels and the system is amenable to fuel pre-conditioning. Other embodiments of the invention are disclosed in which the piston retracts to bring fuel to the combustion chamber and in which the valving piston is a slide or rotary mechanism.

A more complete understanding of the present invention will become apparent from the following description, claims and drawings in which:

For purposes of description throughout the specification, certain terms will be used for reference only and are not to be regarded as limiting. For example, the terms "upwardly", "downwardly", "extend" and "retract" refer to the drawings to which reference is made and are used for convenience and purposes of explanation and not by way of limitation.

Figure 1:
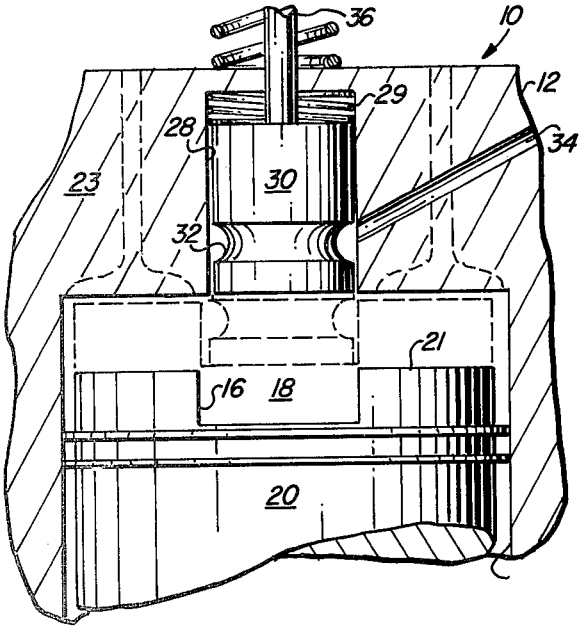
FIG. 1 is a partial cross-sectional view of the top end of a cylinder illustrating one form of the fuel delivery system of the present invention with the alternate position of the valving piston illustrated in dotted lines.

Turning now to the drawings, FIG. 1 illustrates a preferred form of the invention and is generally designated by the numeral 10 and includes an engine block 12 having a cylinder bore 14. It will be understood that the present invention is applicable to various types of combustion engines, both spark ignition and compression ignition and may be applied to engines of various bore sizes and having any number of cylinders. For purposes of convenience of illustration, the invention is shown as applied only to a single cylinder of an engine.

A piston 20 is reciprocal within bore 14. Piston 20 is shown as having a generally flat top surface 21 which defines annular, central recess 16. Piston 20 is provided with conventional rings for sealing at the bore. A combustion chamber 18 is defined between the piston 20 and the upper end of cylinder bore 14.

The head 23 of engine block 12 is provided with conventional valving for regulating admission of combustion air and for discharging products of combustion at appropriate times in the combustion cycle. The construction and the operation of such valves are well known and further detailed discussion is not necessary to an understanding of the present invention. A fuel supply chamber comprising a cylindrical bore 28 is provides in head 23 and communicates with combustion chamber 18. Cylindrical bore 28 is aligned with recess 16 in piston 20. Fuel delivery valving piston 30 is reciprocal within bore 28. An annular groove 32 is provided near the lower end of piston 30 and defines a fuel port or pocket between the bore and piston. In FIG. 1, fuel delivery valving piston 30 is shown in the retracted position in which a fuel port in the form of an annular groove 32 is in communication with fuel passageway 34. Fuel passageway 34 is connected to an appropriate source of fuel such as a fuel pump. Cylinder 30 is operated by a push rod 36 which is connected to a rocker shaft, cam shaft or other mechanism to extend piston 30 at the appropriate time in the combustion cycle.

The operation of the fuel delivery system of the present invention will be more completely understood from the following description of operation. Piston 30 is held in the retracted position shown in FIG. 1 by push rod assembly 36. In this position, the annular groove receives a predetermined quantity of fuel from fuel line 34. At the appropriate time in the cycle, push rod 36 actuates fuel delivery piston 30 downwardly to the position shown in dotted in FIG. 1. This normally occurs at the bottom of the suction stroke or beginning of the compression stroke. The downward displacement of piston 30 transports the discrete fuel charge in annular space 32 into combustion chamber 18. The cylindrical recess 16 allows the lower end of fuel delivery piston 30 to remain in the combustion chamber as the piston approaches top dead center without interference. Fuel delivered to the combustion chamber ignites and as combustion occurs, engine piston 20 is downwardly reciprocated on the power stroke. Piston 30 is returned to the position shown in FIG. 1 in solid lines to receive an additional fuel charge and the operational cycle is repeated. Spring 29 serves to dampen "ignition shock" primarily in compression ignition engines. Peak pressures generated at ignition will be dampened by compression of spring 29.

Figure 2A:
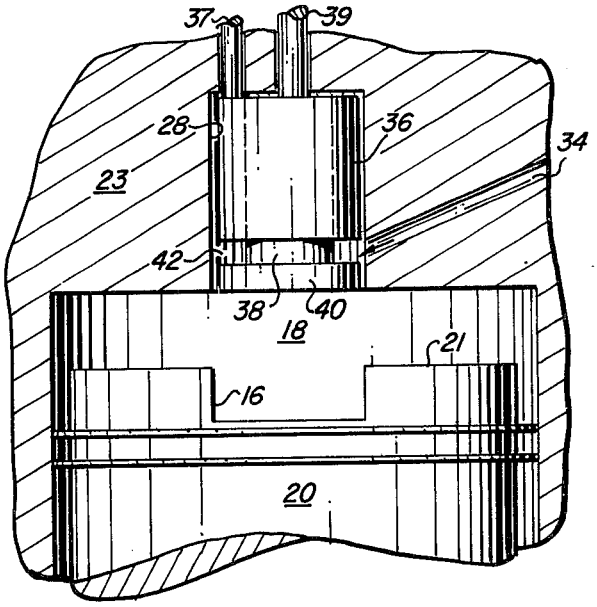
FIG. 2A is a broken away view of a top end of a cylinder of an internal combustion engine illustrating another form of the present invention.
Figure 2B:
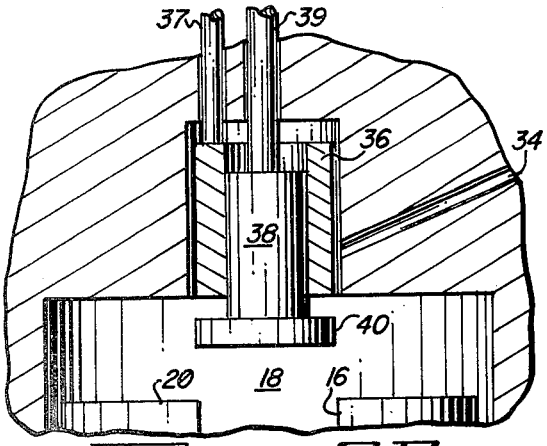
FIGS. 2B and 2C illustrate the operation of the valving piston shown in FIG. 2A.
Figure 2C:
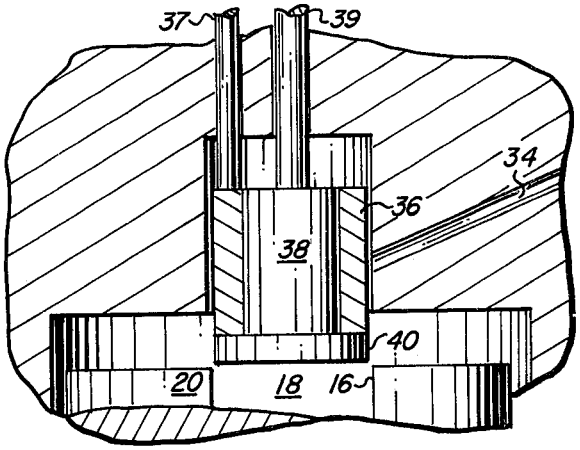

FIGS. 2A–2C show another configuration of the fuel delivery system of the present invention. For convenience, elements identified in this figure and other figures of the same or a similar nature will be identified with the same numeral. Again, engine piston 20 is reciprocal within cylinder bore 14. Cylinder 20 defines a cylindrical recess 16 in the upper surface 21. A combustion space 18 is defined within the upper end of cylinder bore 14. A concentric cylindrical bore 28 is provided in the engine head 23 aligned with cylindrical recess 16. An annular sleeve 36 is reciprocal within bore 28. Piston member 38 is, in turn, reciprocal relative to sleeve 36. The lower end of sleeve 36 terminates immediately above fuel passageway 34. The lower end of piston 38 is provided with a cylindrical end section 40 having a diameter corresponding to the approximate diameter of bore 28 and of cylindrical recess 16 in engine piston 20. In effect, an annular groove or port 42 is defined between the lower end of sleeve 36, the annular interior surface of end section 40 and the bore 28.

In operation, fuel is delivered into annular port 42 by fuel line 34. As seen in FIG. 2B, at the appropriate time in the combustion cycle, the sleeve 36 and piston 38 descend into combustion chamber 18 as a unit. The quantity of fuel contained within space 42 is delivered into combustion chamber 18. The movement of sleeve 36 and piston 38 is controlled by push rod 39 and plunger 37 which may be respectively connected to a cam assembly in the engine or to a rocker arm mechanism or similar actuating mechanism. After the sleeve 36 and piston 38 have moved into the combustion chamber, piston 38 is held in a stationary position and sleeve 36 is actuated downwardly relative to piston 38 as seen in FIG. 2C. The downward movement of sleeve 36 causes fuel within the opening or groove 42 to be expelled or "stripped" from the groove and forced into the combustion chamber 18. The closing of port 42 causes the fuel to be distributed throughout the combustion area and will improve combustion characteristics as atomization of fuel takes place. The combustion characteristics of the engine can be modified by controlling the rate of closure of space 42. Since piston 38 remains in the combustion chamber during at least part of the return and power stroke, recess 16 provides clearance for the lower end of piston 38 and sleeve 36. In this embodiment, conventional valving and timing mechanisms have again, been omitted for purposes of clarity.

Figure 3A:
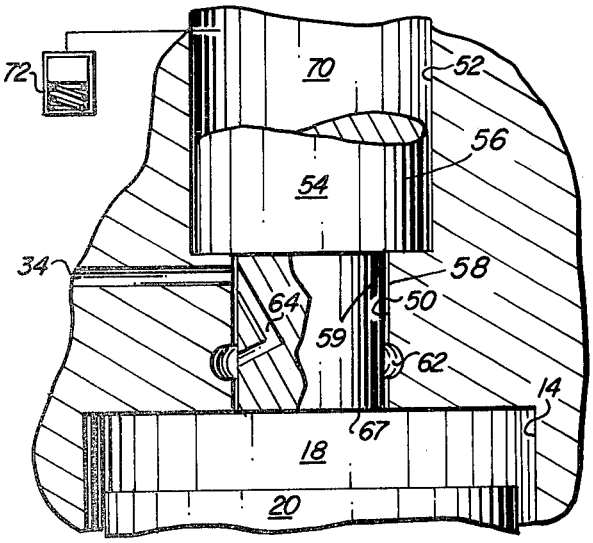
FIG. 3A is a partial cross-sectional view of the top end of a cylinder of an internal combustion engine illustrating another form of the present invention.
Figure 3B:
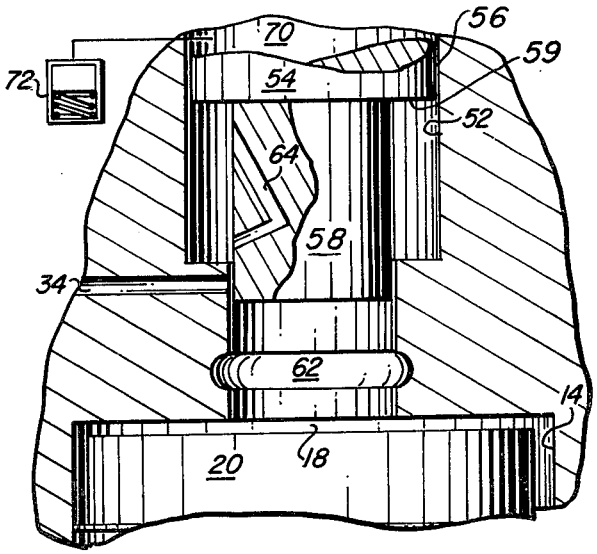
FIG. 3B shows the valving piston of FIG. 3A in the fuel delivery position.

Turning now to FIGS. 3A and 3B, another embodiment of the present invention is illustrated. Cylinder bore 14 defines combustion chamber 18. Piston 20 is reciprocal within bore 14. The fuel delivery or transportation system includes a larger diameter bore 52 and a smaller diameter bore 50 concentrically aligned with the combustion chamber in the cylinder head. Fuel delivery piston 54 has a major diametrical section 56 and a minor diametrical section 58 joining at shoulder 59. In the position shown in FIG. 3A, the piston 54 isolates fuel from combustion chamber 18. A fuel port defined at annular groove 62 is provided in bore 50. Fuel passageway 34 communicates with bore 50 adjacent port 62 with fuel passing across internal passageway 64 formed in piston 54. Fuel supplied through fuel line 34 will be communicated via passageway 64 filling port 62.

A fluid pressure chamber 70 is defined between the upper end of bore 52 and the upper surface 66 of piston 54. Chamber 70 communicates with a pressure accumulator 72 which maintains a predetermined pressure in chamber 70. Accumulator 72 is conventional and the working fluid may be hydraulic or pneumatic. As engine piston 20 travels upwardly on the compression stroke, the pressure increases in combustion chamber 18. The increased pressure in combustion chamber 18 will be applied to the lower surface 67 of piston 54. At a predetermined pressure level, the pressure exerted against surface 67 will overcome the fluid pressure acting against surface 66, causing piston 54 to move upwardly a distance until surface 67 clears groove 62 and assumes the position shown in FIG. 3B. Groove 62 will be in direct communication with the combustion chamber 18 and fuel in groove 62 will be dispersed within the combustion chamber initiating combustion. As piston 20 descends on a power stroke, the pressure in chamber 18 will recede, permitting fuel valving piston 54 to return to the downward position shown in FIG. 3A.

The present invention also provides additional advantages as the engine can be adapted for variable compression ratio. For example, the accumulator 72 in FIGS. 3A and 3B can be programmed to permit at least limited upward movement of valving piston 54 at the appropriate time in the operational cycle to maintain essentially constant or uniform pressure in the compression chamber. The upward movement would be restricted so that fuel port 62 remains isolated from combustion chamber 18 but the increased volume of the lower portion of bore 50 will increase the effective area of the combustion chamber.

Further, accumulator 72 can also be programmed by varying the accumulator pressure to permit valving piston 54 to retract during starting conditions to reduce the compression ratio during start-up making starting of the engine easier.

Figure 4:
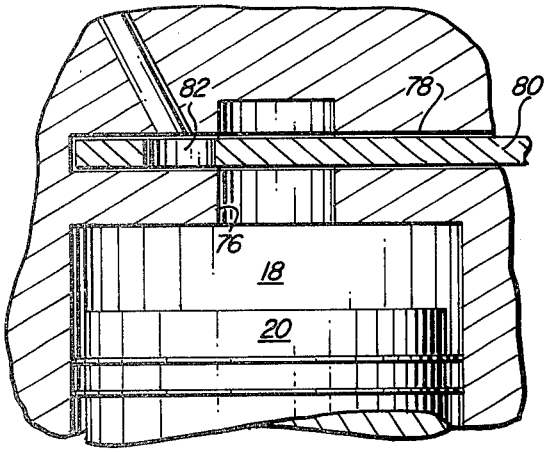
FIG. 4 is a partial cross-sectional view of a top end of a cylinder of an internal combustion engine illustrating a form of the present invention utilizing a reciprocating slide valve for fuel delivery.
Figure 5:
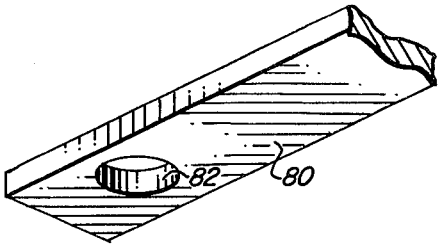
FIG. 5 is a perspective view illustrating the slide valve.

FIGS. 4 and 5 show still another form of the present invention. In FIG. 5 piston 20 is reciprocal within cylinder bore 14. Combustion chamber 18 is defined in the upper end of cylinder bore 14. Cylindrical passage 76 is provided at the upper end of the cylinder chamber and communicates with the combustion chamber. A transverse slot 78 intersects recess 76. Fuel inlet line 34 communicates with valve slot 78. A slide valve 80 is reciprocal within slot 78. Body 80 defines an aperture or opening 82 near one end of body 80. In the position shown in FIG. 4, aperture 80 registers with fuel line 34 and is sealed from communication with passage 76. Rightward actuation of valve member 80 will move aperture 82 into registry with passage 76 permitting fuel to be transported into the combustion chamber 18. Actuation of valve body 80 may be by any conventional mechanical means and timed in accordance with the operational cycle of the engine. For example, valve body 80 may be acutated by the engine cam shaft or by an appropriate push rod.

The particular configuration and shape of passage 76 may be varied to change the combustion characteristics of the engine. Further, means can be provided in registry with aperture 82 in the fuel delivery position to assist in expelling or forcing the fuel from the aperture. Such means may include a plunger in registry with the aperture. Other means of expelling fuel may include constructing slide member 80 similar to piston 38 as shown in FIG. 2. In this construction, the entire slide will move as a unit into the fuel delivery position. Thereafter, relative movement between component parts of the slide would occur closing aperture 82, expelling fuel under pressure into the combustion area.

Figure 6:
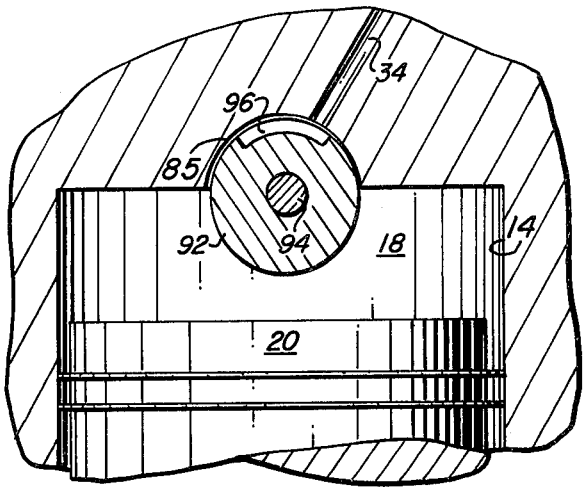
FIG. 6 is a cross-sectional view of the top end of a cylinder of an internal combustion engine illustrating still another form of the present invention.
Figure 7:
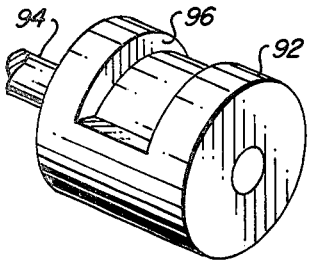
FIG. 7 is a perspective view illustrating the rotary valve shown in the embodiment of FIG. 6.

Still another form of the invention is illustrated in FIGS. 6 and 7. As shown, piston 20 is reciprocal within cylinder bore 14 in the engine block. Semi-circular cavity 85 is formed in the engine head above the piston and communicates with the combustion chamber. A rotary valve member 92 is positioned in cavity 92 and mounted on shaft 94. Rotation of shaft 94 is controlled by an appropriate timing device. Rotary valve member 92 has a peripheral groove 96 which defines a fuel pocket. In the position shown in FIG. 6, fuel pocket 96 communicates with fuel supply 34. When rotary valve member 92 is rotated to the appropriate position, as for example, 180° from the indicated position, fuel pocket 96 is in registry with combustion chamber 18.

Figure 8:
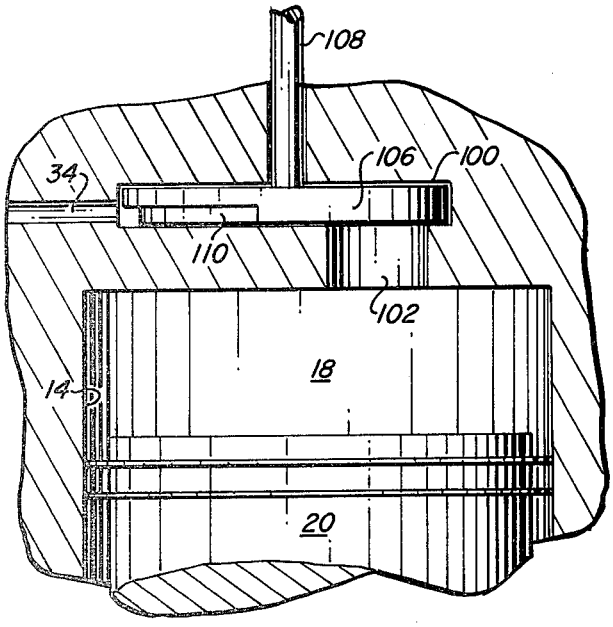
FIG. 8 is a partial cross-sectional view of the type of a cylinder illustrating another form of the invention utilizing a rotary valving piston.
Figure 9:
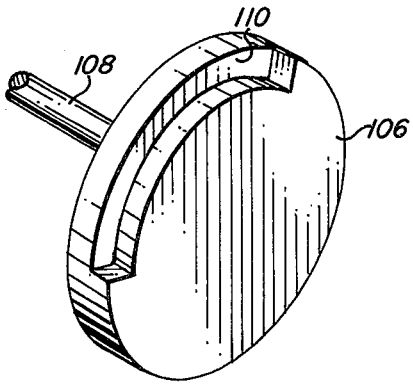
FIG. 9 is a perspective view showing the rotary valve piston of FIG. 8.

FIGS. 8 and 9 illustrate another form of the invention. Piston 20 is reciprocal in cylinder bore 14. A cylindrical cavity 100 is formed in the engine block adjacent combustion chamber 18 and communicates with the chamber 18 by means of passage 102. A disc 106 is mounted for rotation in cavity 100. Disc 106 is operated by shaft 108. A peripheral groove 110 defines a fuel pocket. As seen in FIG. 8, fuel pocket 110 is rotative to receive a charge or discrete quantity of fuel from fuel line 34. At the proper time in the cycle, shaft 108 is rotated to place pocket 110 in communication with passage 102 delivering fuel to combustion area 18.

It will be seen from the foregoing that the present invention provides a unique fuel delivery system in which a predetermined or discrete quantity of fuel is transported or delivered to the combustion chamber area of an internal combustion engine. The advantage of transporting a predetermined quantity of fuel in the manner described is that it eliminates the need for complex injectors and substantially increases the reliability of the fuel delivery system. Further, the fuel delivery system may also include additional "stripping" means which serve to expel the fuel into the combustion chamber and atomize the fuel in the chamber. The advantages of the present system, compared to existing direct injection systems, are substantial and involve considerations of simplicity of design and low cost. Further, the present invention can be used with low pressure fuel supplies in contrast to injection systems which require a substantially high pressure regulated fuel supply. Further, the delivery system of the present invention does not expose critical, small nozzle openings or orifices to combustion areas which can result in clogging and contamination. Problems with leakage or drip are avoided by the present invention. The fuel delivery system of the present invention has a capability of maintaining constant volume for a longer period of time during the combustion process by timing the relative position and motion of the main engine piston and injection piston.

The fuel delivery system of the present invention as pointed out above is compatible and can be used with both combustion ignition engines and spark ignition engines. Although several particular preferred embodiments of the invention have been disclosed in detail for illustrative purposes, it will be recognized that various modifications and changes of the disclosed apparatus, including the rearrangement of parts, will be readily apparent to those skilled in the art and it is intended such changes and modifications are within the scope of the present invention.

I claim:

1. A fuel delivery system for a combustion engine having an engine block defining a cylinder bore, a piston reciprocal in the bore and defining with the bore a combustion area, intake and exhaust valves for controlling the admission of air to and exhaust combustion gases from a combustion area, said fuel delivery system comprising:

(a) a fuel chamber in the engine block independent of said intake and exhaust valves, said fuel chamber being in open communication with said combustion area;

(b) a fuel conduit communicating with said fuel chamber;

(c) valving means within said fuel chamber, said fuel chamber and valving means defining a fuel port therebetween;

(d) means for actuating said valving means from a first position communicating said fuel conduit and said fuel port and in which said first position said fuel port is isolated from said combustion area to a second position placing said fuel port directly in said combustion area and isolating said fuel conduit from said fuel port; and (e) dampening means associated with said valving means for permitting limited movement of said valving means to dampen ignition shock.

2. The system of claim 1 wherein said valving means comprises a piston and said fuel port comprises an annular groove formed in said piston.

3. The fuel delivery system of claim 1 wherein said means for actuating said valving means comprises spring means.

4. The fuel delivery system of claim 1 wherein said means for actuating said valving means comprises a cam actuated push rod.

* * * * *